US010086915B2

(12) United States Patent
Angle et al.

(10) Patent No.: US 10,086,915 B2
(45) Date of Patent: Oct. 2, 2018

(54) COLLAPSIBLE PRIVACY ENCLOSURE

(71) Applicant: LIPPERT COMPONENTS, INC., Elkhart, IN (US)

(72) Inventors: Shannon Angle, Fort Wayne, IN (US); Christopher D. Jones, Fort Wayne, IN (US)

(73) Assignee: LIPPERT COMPONENTS, INC., Elkhart, IN (US)

( * ) Notice: Subject to any disclaimer, the term of this patent is extended or adjusted under 35 U.S.C. 154(b) by 193 days.

(21) Appl. No.: 15/339,457

(22) Filed: Oct. 31, 2016

(65) Prior Publication Data

US 2017/0119164 A1 May 4, 2017

Related U.S. Application Data

(60) Provisional application No. 62/248,673, filed on Oct. 30, 2015.

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04; B63B 2029/043
USPC ..... 297/118, 129
See application file for complete search history.

(56) References Cited

U.S. PATENT DOCUMENTS 3,439,467 A 4/1969 Partlow
4,883,016 A 11/1989 Larson
5,029,348 A * 7/1991 Boren ..... B63B 15/00 4/312
5,263,210 A 11/1993 Pollard
5,379,466 A 1/1995 Davies
6,302,053 B1 * 10/2001 Tomczak ..... B63B 17/02 114/363
D481,986 S * 11/2003 Menne ..... D12/317
6,672,240 B1 * 1/2004 Aube ..... B63B 19/14 114/343
6,681,713 B2 1/2004 Scott et al.
6,701,863 B2 * 3/2004 Kalhok ..... B63B 17/02 114/343
6,715,255 B2 * 4/2004 Schipani ..... A47F 5/13 182/152
6,715,440 B2 4/2004 Biedenweg et al.
6,722,732 B1 4/2004 Menne
D494,126 S * 8/2004 Menne ..... D12/317
6,986,230 B2 * 1/2006 Schipani ..... A47F 5/13 211/199

(Continued)

FOREIGN PATENT DOCUMENTS

DE 2241842 3/1974
EP 2110054 10/2009

(Continued)

*Primary Examiner* — David E Allred
(74) *Attorney, Agent, or Firm* — Barnes & Thornburg LLP

(57) ABSTRACT

A collapsible privacy enclosure includes a lower frame section, a middle frame section, and an upper frame section. The middle frame section is reconfigurable between a deployed configuration and a stowed configuration. The upper frame section includes a tilting portion and is reconfigurable between a deployed configuration and a stowed configuration. A curtain rod is deployable from the upper frame section.

17 Claims, 12 Drawing Sheets

(56) References Cited

U.S. PATENT DOCUMENTS

| | | | | |
|---|---|---|---|---|
| 7,100,333 | B2 * | 9/2006 | Hoberman | E04B 1/3211 135/29 |
| 7,117,646 | B2 * | 10/2006 | Blaisdell | B63B 17/00 52/79.5 |
| 7,222,466 | B2 * | 5/2007 | Schipani | A47F 5/13 182/152 |
| 7,228,811 | B2 * | 6/2007 | Huff | B63B 19/12 114/201 R |
| 7,469,513 | B2 * | 12/2008 | Schipani | A47F 5/13 52/646 |
| 7,540,215 | B2 * | 6/2009 | Hoberman | E04B 1/3441 428/12 |
| 7,559,174 | B2 * | 7/2009 | Hoberman | E04B 7/166 52/66 |
| 7,644,721 | B2 * | 1/2010 | Hoberman | E04H 15/48 135/123 |
| 7,866,369 | B2 * | 1/2011 | Domolato | A47C 13/00 160/351 |
| 8,777,304 | B2 * | 7/2014 | Dixon | A47D 11/005 297/1 |
| 8,991,914 | B2 | 3/2015 | Grovender | |
| 2004/0011272 | A1 * | 1/2004 | Biedenweg | B63B 29/02 114/343 |

FOREIGN PATENT DOCUMENTS

| | | |
|---|---|---|
| FR | 981385 | 5/1951 |
| GB | 621095 | 4/1949 |
| WO | 2013131946 | 9/2013 |

* cited by examiner

COLLAPSIBLE PRIVACY ENCLOSURE

CROSS-REFERENCE TO RELATED APPLICATION

This application claims benefit under 35 U.S.C. § 119 of U.S. Provisional Patent Application No. 62/248,673, filed on Oct. 30, 2015, the disclosure of which is incorporated herein by reference in its entirety.

BACKGROUND AND SUMMARY OF THE DISCLOSURE

A marine privacy enclosure is a space that may be provided on a boat or elsewhere for enclosing a head or an area for changing clothes. Some marine privacy enclosures comprise fabric curtains that may be attached to and hung from a Bimini top or a hard top. Such curtains may be removed and stowed when not in use. Other marine privacy enclosures comprise convertible structures that may function as a privacy enclosure when deployed and as seating when stowed. Such convertible structures may provide a frame from which to hang a removable fabric curtain.

DETAILED DESCRIPTION OF THE DRAWINGS

Figure 1:
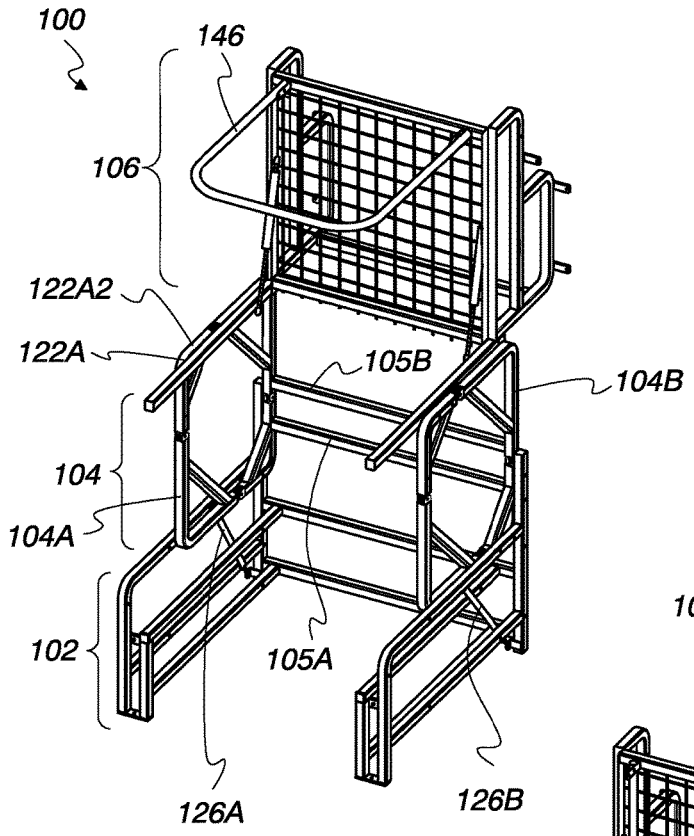
FIG. 1 is a perspective view of a framework of an illustrative collapsible enclosure according to the present disclosure, with the framework in a fully deployed position.

FIGS. 1-13 show an illustrative embodiment of a collapsible enclosure 100 according to the present disclosure. The collapsible enclosure 100 includes a frame that can be transitioned between a first (or deployed or enclosure) configuration, as best shown in FIG. 1, and a second (or collapsed or seating) configuration, as best shown in FIG. 5. The frame is provided in three sections, namely, a lower frame section 102, a middle frame section 104, and an upper frame section 106.

Figure 9:
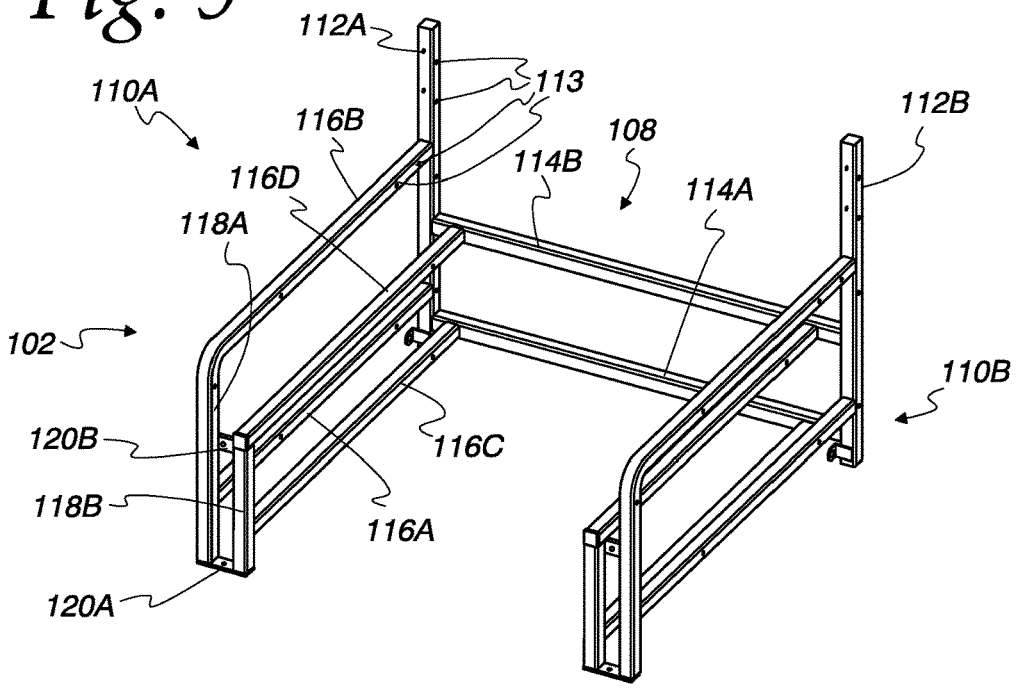
FIG. 9 is a perspective view of a lower frame section of the illustrative collapsible enclosure of FIG. 1.

As best shown in FIG. 9, the lower frame section 102 includes a back portion 108 and first and second side portions 110A, 110B. The back portion 108 is shown as including first and second spaced-apart, parallel vertical posts 112A, 112B and first and second spaced-apart, parallel horizontal beams 114A, 114B, each having a first end attached to the first post 112A and a second end attached to the second post 112B. The first beam 114A is attached to the first and second posts 112A, 112B near respective lower ends thereof, and the second beam 114B is attached to the first and second posts near respective midpoints thereof.

Each of the first vertical post 112A and the second horizontal beam 116B may define one or more apertures 113 extending therein or there through for receiving fasteners (not shown) that may be used to attach other components thereto, as will be discussed further below.

The first and second side portions 110A, 110B are shown as mirror images of each other. As such, only the first side portion 110A will be described herein in detail. The first side portion 110A includes first and second spaced apart and parallel horizontal beams 116A, 116B extending between the first vertical post 112A of the back portion to a first vertical post 118A of the first side portion. The first side portion 110A also includes third and fourth spaced apart and parallel horizontal beams 116C, 116D extending, respectively, from the first and second horizontal beams 114A, 114B of the back portion 108 to a second vertical post 118B of the first side portion. A first strap 120A connects a lower portion of the first post 118A of the first side portion 110A to a lower portion of the second post 118B of the first side portion. A second strap 120B connects an intermediate portion of the first post 118A of the first side portion 110A to an upper portion of the second post 118B of the first side portion. The first and second horizontal beams 116A, 116B of the first side portion 110A define a first vertical plane, and the third and fourth horizontal beams of the first side portion define a second vertical plane parallel to and spaced apart from the first vertical plane.

Figure 2:
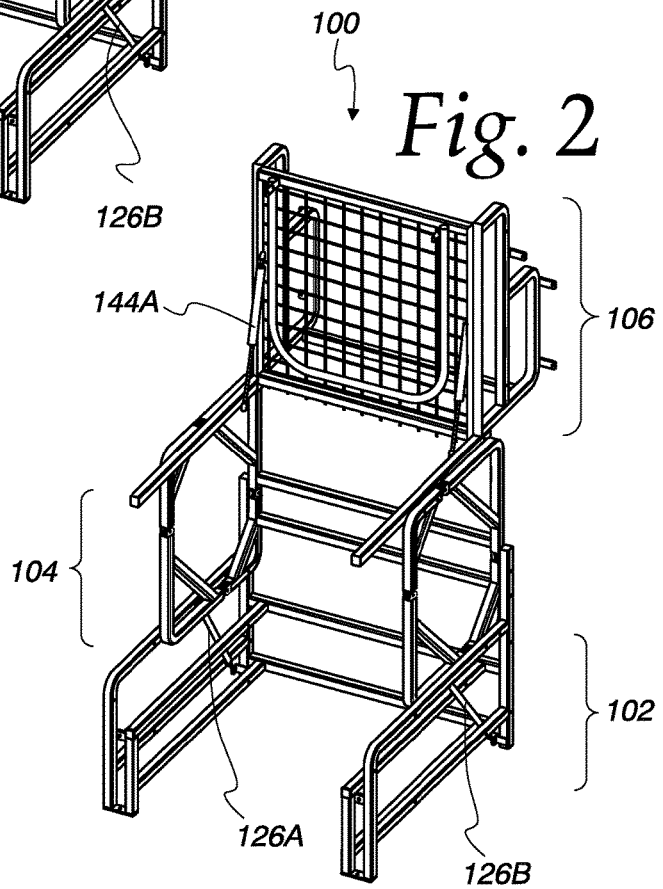
FIG. 2 is a perspective view of a framework of an illustrative collapsible enclosure according to the present disclosure, with the framework in a partially deployed position.
Figure 4:
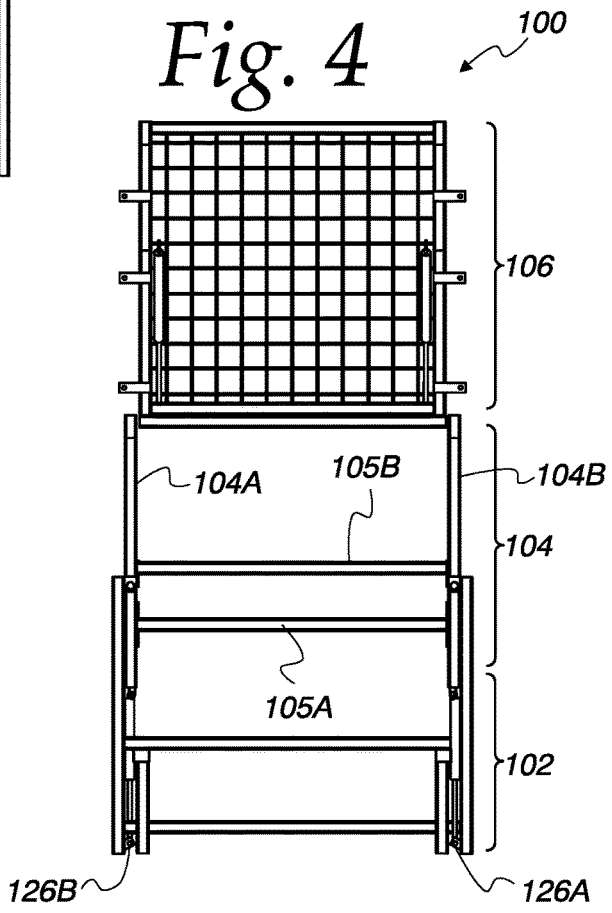
FIG. 4 is a rear elevation view of the framework of the illustrative collapsible enclosure of FIG. 1, with the frame work in a fully deployed position.
Figure 5:
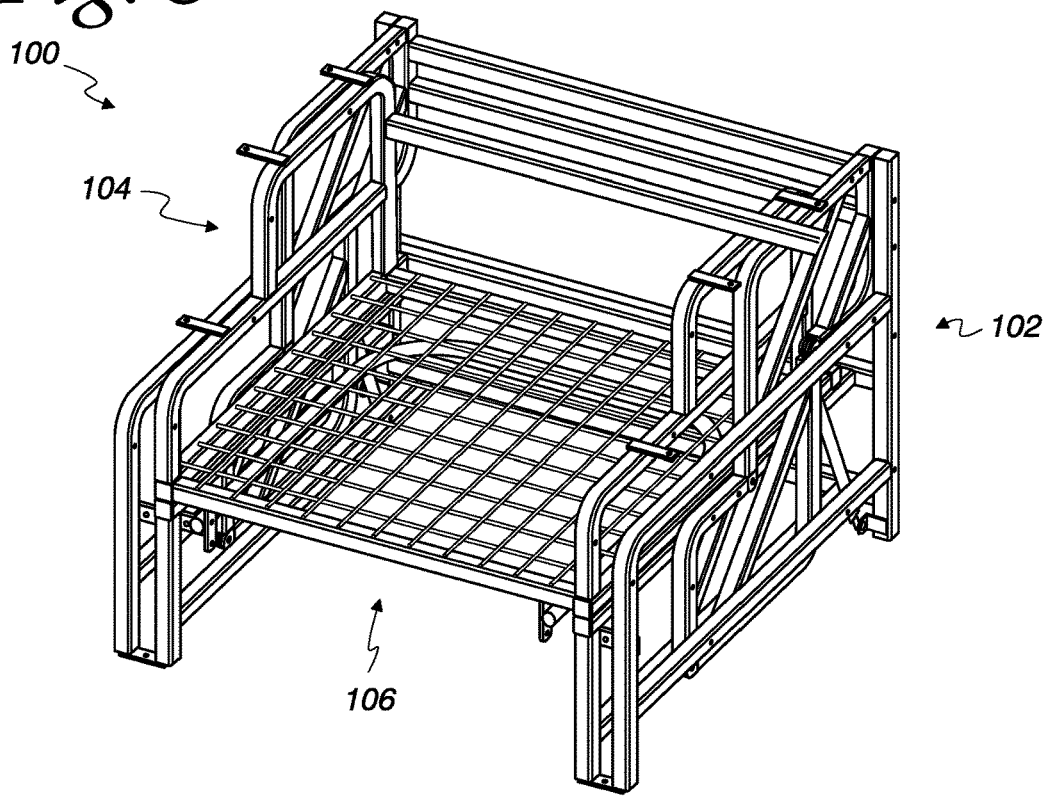
FIG. 5 is a perspective view of the framework of the illustrative collapsible enclosure of FIG. 1, with the frame work in a collapsed position.

As best shown in FIGS. 1, 2, and 4, the middle frame section 104 includes a first side portion 104A and a second side portion 104B. The first side portion 104A is connected to the second side portion 104B by first and second horizontal beams 105A, 105B. The first and second side portions 104A, 104B are shown as identical to or mirror images of each other. As such, only the first side portion 104A will be described herein in detail.

The first side portion 104A includes first, second, third, and fourth L-shaped sections 122A, 122B, 122C, 122D pivotally connected to each other. More specifically, the first side portion 104A includes a first L-shaped section 122A, a second L-shaped section 122B pivotally connected to the first L-shaped section by a first hinge 124A, a third L-shaped section 122C pivotally connected to the second L-shaped section by a second hinge 124B, and a fourth L-shaped section 122D pivotally connected to the third L-shaped section by a third hinge 124C. The fourth L-shaped section 122D also is pivotally connected to the first L-shaped section 122A by a fourth hinge 124D.

Each of the L-shaped sections 122A, 122B, 122C, 122D is defined by a first leg and a second leg generally perpendicular to the first leg. The first and second legs of each L-shaped section are identified in the drawings with (and may be referred to herein using) the suffixes "1" and "2", respectively. The first and second legs of individual ones of the L-shaped sections 122A, 122B, 122C, 122D are generally of equal length. The first and second legs of the first L-shaped section 122A are generally the same length of the first and second legs of the third L-shaped section 122C. Similarly, the first and second legs of the second L-shaped section 122B are generally the same length of the first and second legs of the fourth L-shaped section 122D. The first and second legs of the first and third L-shaped sections 122A, 122C are relatively short compared to the first and second legs of the second and fourth L-shaped sections 122B, 122D. In an embodiment, the first and second legs of the first and third L-shaped sections 122A, 122C are about half as long as the first and second legs of the second and fourth L-shaped sections 122B, 122D.

The L-shaped sections 122A, 122B, 122C, 122D are shown as having rectangular cross-sections. In other embodiments, the L-shaped sections 122A, 122B, 122C, 122D could have other cross-sections. They could be solid or tubular. The first and second legs thereof could be formed monolithically by bending a piece of stock to the desired form, by joining individual pieces of stock by welding, bonding, or using mechanical fasteners, or any combination thereof.

Each of the L-shaped sections 122A, 122B, 122C, 122D may include a stiffener 122A3, 122B3, 122C3, 122D3 joining the first and second legs thereof. For example, each of the L-shaped sections 122A, 122B, 122C, 122D may include a stiffener 122A3, 122B3, 122C3, 122D3 joining the first and second legs thereof such that the respective first leg, second leg, and stiffener form an isosceles triangle. The stiffeners 122A3, 122B3, 122C3, 122D3 could be attached to the first and second legs by welding, bonding, using mechanical fasteners, or any combination thereof.

Figure 10:
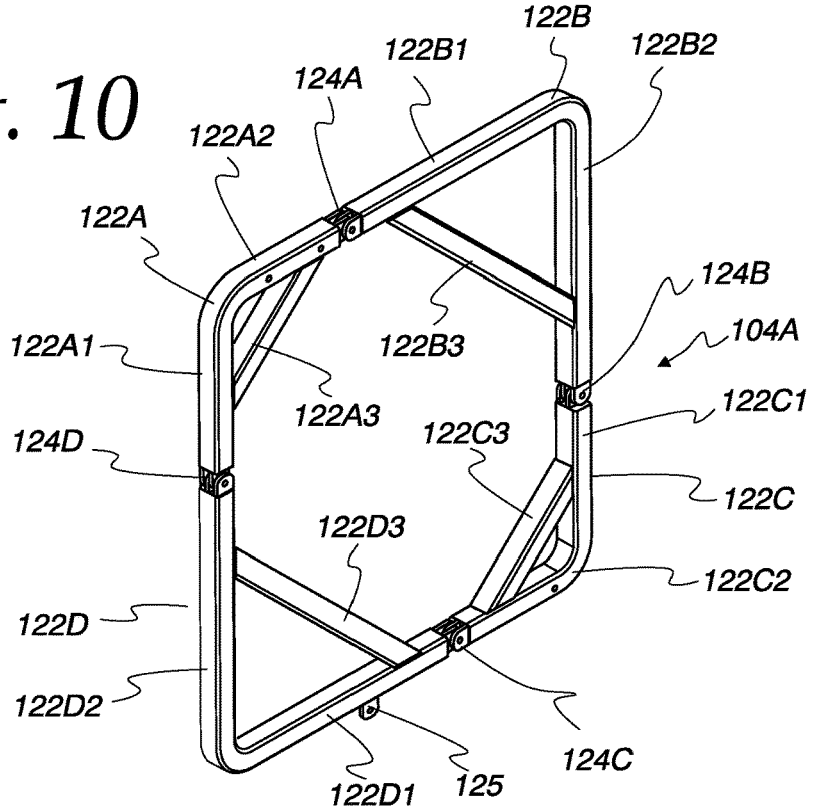
FIG. 10 is a perspective view of a first side portion of a middle frame section of the illustrative collapsible enclosure of FIG. 1 in a fully deployed position.
Figure 11:
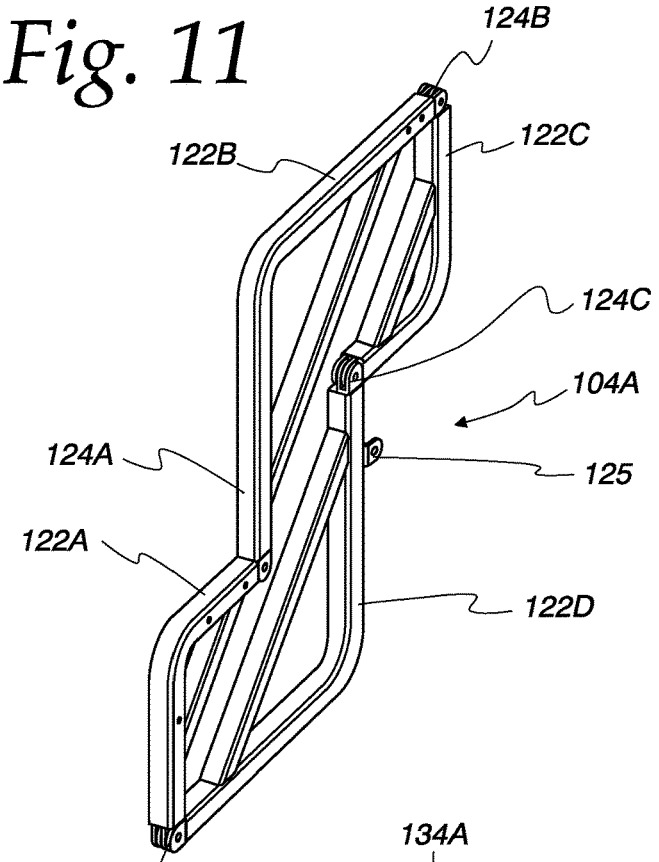
FIG. 11 is a perspective view of the first side portion of the middle frame section of FIG. 8 in a collapsed position.

As best shown in FIGS. 10 and 11, the first side portion 104A of the middle frame section 104 is reconfigurable between a first (or deployed) configuration and a second (or collapsed) configuration (the second side portion 104B of the middle frame section 104 is similarly reconfigurable). In the first configuration, shown in FIG. 9, adjacent legs of the first, second, third, and fourth L-shaped sections 122A, 122B, 122C, 122D (for example, the second leg 122A2 of the first L-shaped section 122A and the first leg 122B1 of the second L-shaped section 122B) are generally collinear, and the first side portion of the middle frame section 104, viewed from the side, has a generally rectangular form. In the second configuration, adjacent legs of the first, second, third, and fourth L-shaped sections 122A, 122B, 122C, 122D are generally perpendicular to each other, and the first side portion 104A of the middle frame section 104, viewed from the side, has a generally Z-shaped form. Also in the second configuration, the stiffeners 122A3, 122D3 of the first and fourth sections L-shaped sections 122A, 122D are generally collinear, and the stiffeners 122B3, 122C3 of the second and third L-shaped sections 122B, 122C are generally collinear.

As shown, the third L-shaped section 122C of the first side portion 104A of the middle frame section 104 is fixed to the lower frame section 102. For example, third L-shaped section 122C may be fixed to one or both of the first vertical post 112A and the second horizontal beam 116B of the lower frame section using fasteners (not shown) or otherwise. As such, when the first side portion 104A is transitioned from the first configuration to the second configuration, the third L-shaped section 122C remains stationary with respect to the lower frame section 102 and the first, second, and fourth L-shaped sections 122A, 122B, 122D, the second and fourth L-shaped sections rotate in a first direction with respect to the third L-shaped section and the first L-shaped section, and the first L-shaped section translates with respect to the third L-shaped section. More specifically, as viewed from the perspective of FIGS. 10 and 11, the second and fourth L-shaped sections 122B, 122D rotate counterclockwise with respect to the third L-shaped section 122C and the first L-shaped section 122A translates to the left and downward with respect to the third L-shaped section. When the first side portion 104A is transitioned from the second position to the first position, the reverse movements occur.

The first through fourth L-shaped sections 122A-122D and the first though fourth hinges 124A-124D are configured so that, as the first side portion 104A is transitioned between the first and second configurations, the first leg 122A1 of the first L-shaped section remains parallel to the first leg 122C1 of the third L-shaped section, and the second leg 122A2 of the first L-shaped section remains parallel to the second leg 122C2 of the third L-shaped section.

As shown, the first and second horizontal side rails 116A, 116B of the lower frame section 102 and the third and fourth horizontal side rails 116C, 116D of the lower frame section 102 cooperate to define a space receiving at least a portion of at least some of the first through fourth L-shaped sections 122A-122D of the first side portion 104A, especially when the first side portion is in the collapsed configuration.

As best shown in FIGS. 1-4, a first support strut 126A may be pivotally connected between the lower frame section 102 and the fourth L-shaped section 122D of the first side portion 104A of the middle frame section 104 to assist a user in transitioning the middle frame section 104 between the first and second positions. As shown, a first end of the first support strut 126A is pivotally connected to a lower portion of the first vertical post 112A via an intervening bracket 129, and second end of the first support strut 126A is pivotally connected to the fourth L-shaped section 122D via an intervening bracket 125 attached to the first leg 122D1 of the fourth L-shaped section. The first support strut 126A may be a telescopic actuator, for example, a gas strut. A second support strut 126B analogous to the first support strut 126A is shown as pivotally connected between the lower frame section 102 and the second side portion 104B of the middle frame section 104 in an analogous manner.

As set forth above, the second side portion 104B of the middle frame section 104 may be configured in a manner substantially similar to the first side portion 104A of the middle frame section 104. Also, the second side portion 104B may be connected to the lower frame section 102 in a similar manner similar to the first side portion 104A and transition between first and second positions in a manner substantially similar to the first side portion 104A.

Figure 6:
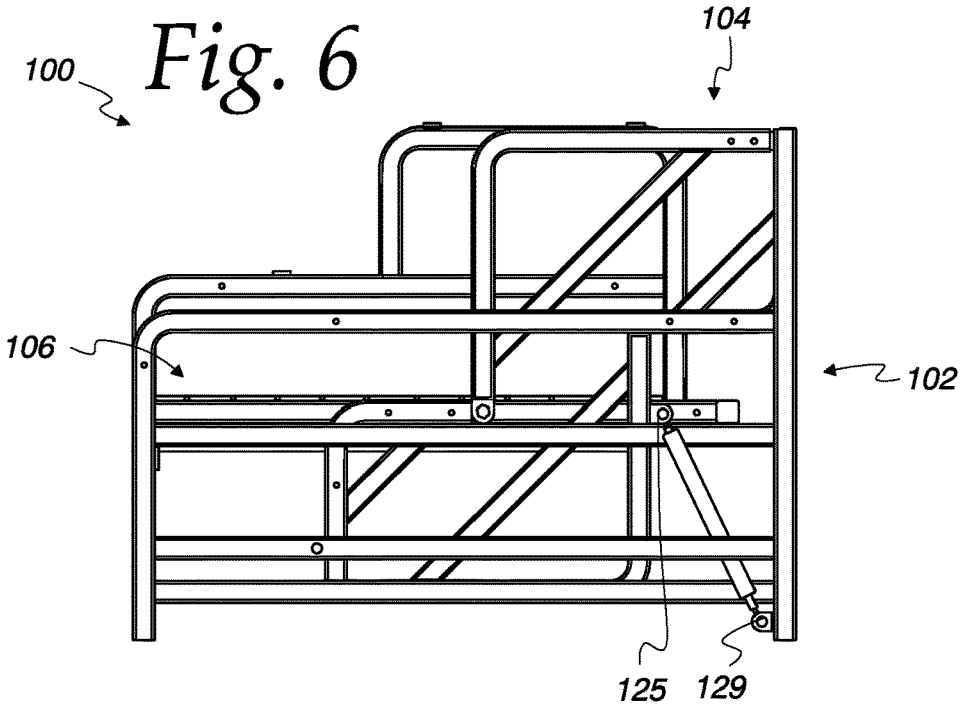
FIG. 6 is an end elevation view of the framework of the illustrative collapsible enclosure of FIG. 1, with the frame work in a collapsed position.
Figure 7:
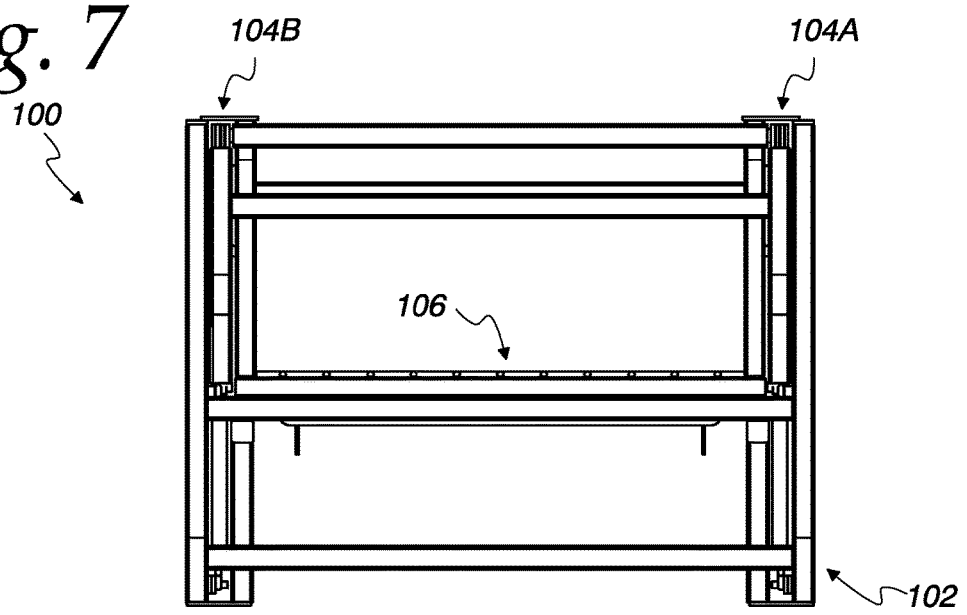
FIG. 7 is a rear elevation view of the framework of the illustrative collapsible enclosure of FIG. 1, with the frame work in a collapsed position.
Figure 8:
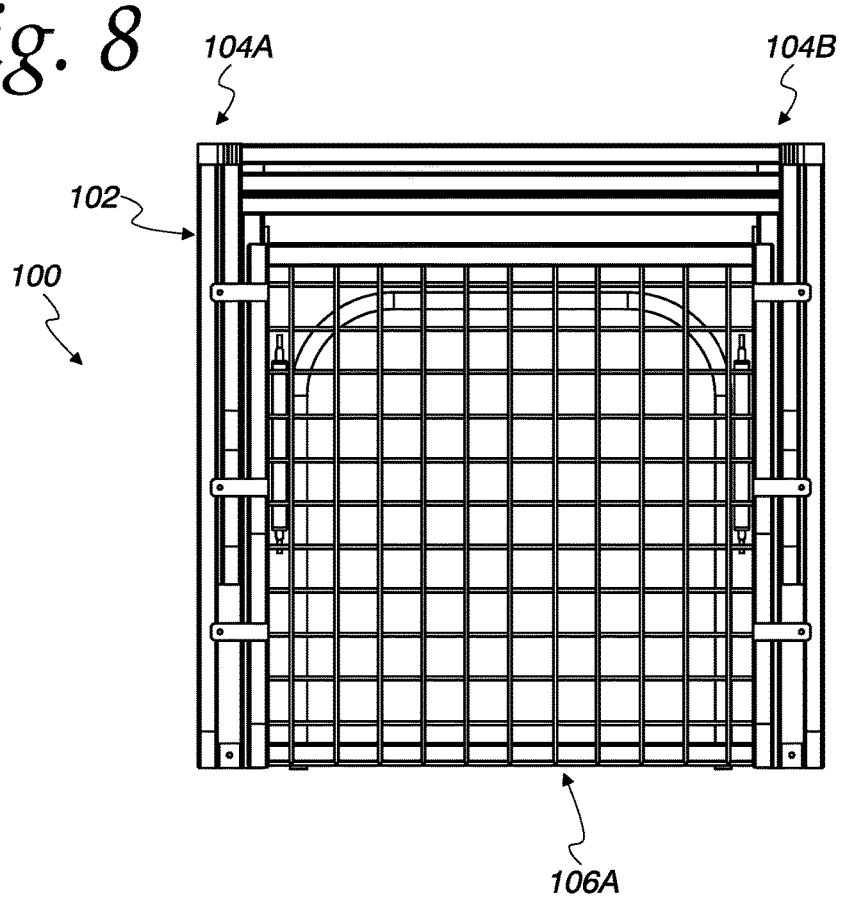
FIG. 8 is a top plan view of the framework of the illustrative collapsible enclosure of FIG. 1, with the frame work in a collapsed position.
Figure 12:
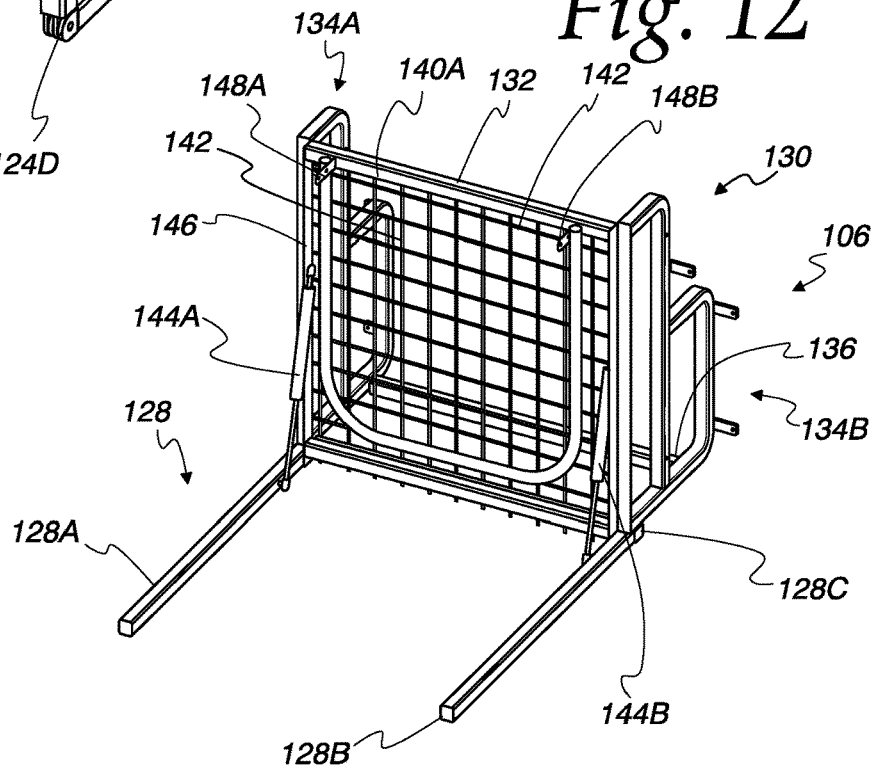
FIG. 12 is a perspective view of an upper frame section of the illustrative collapsible enclosure of FIG. 11 in a partially deployed position.
Figure 13:
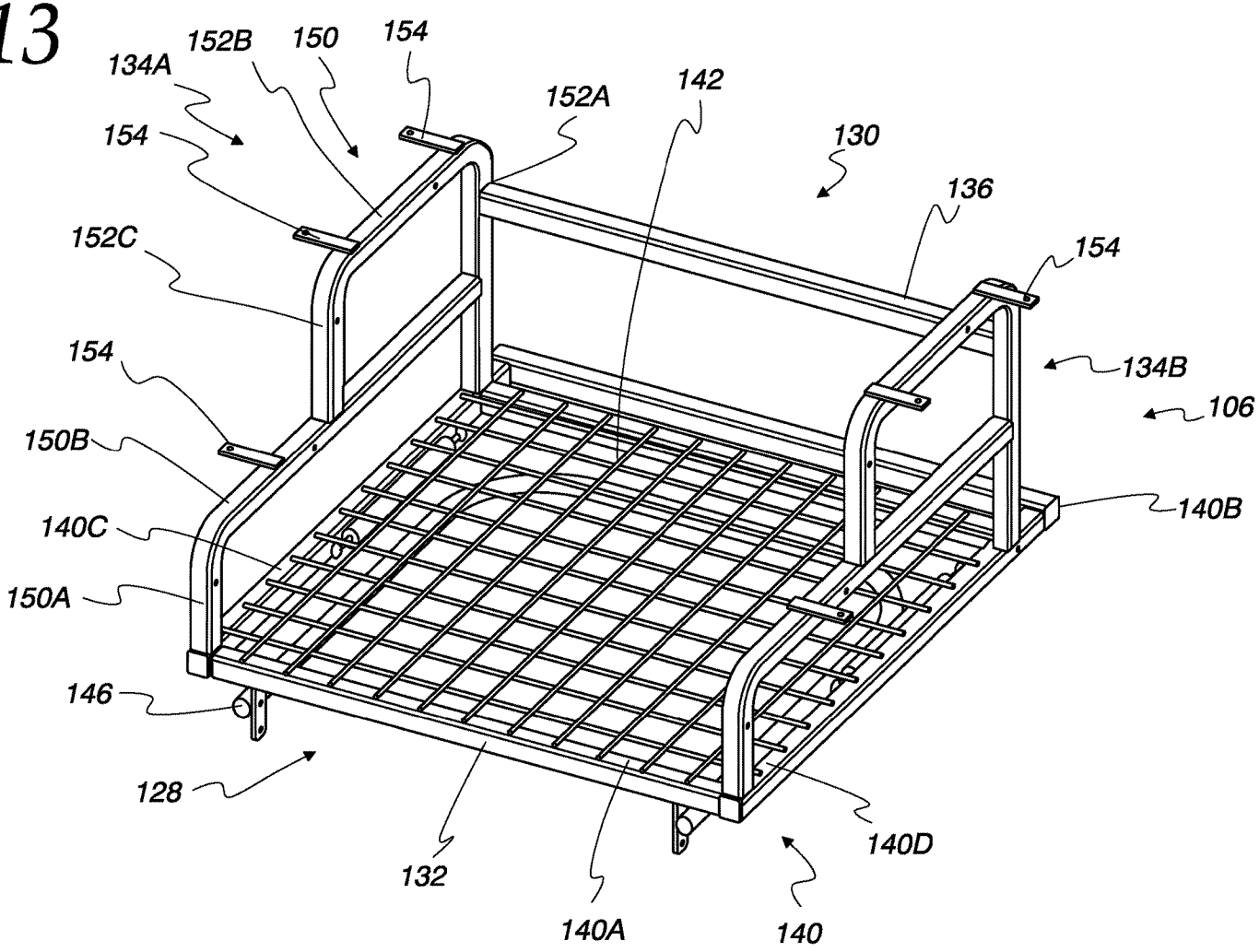
FIG. 13 is a perspective view of the upper frame section of FIG. 12 in a collapsed position.

As best shown in FIGS. 12 and 13, the upper frame section 106 includes a base portion 128 and a tilting portion 130 pivotally connected to the base portion. The base portion 128 includes first and second parallel and spaced-apart horizontal side beams 128A, 128B and a horizontal rear beam 128C connected between respective first (or rear) ends of the first and second side beams. As best shown in FIGS. 1, 5, and 6, the first and second side beams 128A, 128B of the base portion 128 are connected, respectively, to opposing surfaces of the first L-shaped sections 122A of the first and second side portions 104A, 104B of the middle frame section 104.

The tilting portion 130 includes a bottom portion 132, first and second opposed, parallel and spaced-apart side portions 134A, 134B, and a rear beam 136 connecting rear portions of the first and second side portions.

The bottom portion 132 includes a seat frame 140 having a front beam 140A, a rear beam 140B, and first and second side beams 140C, 140D connecting respective first and second ends of the front and rear beams. The front and rear beams 140A, 140B are shown as square tubular members, and the first and second side beams 140C, 140D are shown as structural angles. The first and second side beams 140C, 140D of the seat frame are pivotally connected at respective first (or rear) ends thereof to the respective side beams 128A, 128B of the base portion 128 proximate the rear beam 128C thereof. The first and second side beams 140C, 140D of the seat frame may be notched or otherwise configured as might be necessary to permit pivoting thereof with respect to the respective side beams 128A, 128B of the base portion 128

The bottom portion 132 also includes a seat web 142. The seat web 142 is shown as a grid of metal or fabric attached to the front, rear, and first and second side beams 140A, 140B, 140C, 140D of the seat frame. The seat web 142 may be configured and/or attached to the seat frame in other ways.

A U-shaped curtain rod 146 is pivotally attached to the bottom portion 132 via first and second brackets 148A, 148B located at an underside of the front beam 140A of the seat frame 140.

The upper frame section 106 also includes first and second support struts 144A, 144B pivotally connected between the base portion 128 and the tilting portion 130. As shown, the first and second support struts 144A, 144B are telescopic actuators, for example, gas struts, pivotally at respective first ends thereof to respective intermediate portions of the first and second side beams 128A, 128B of the base portion 128, and pivotally connected at respective second ends thereof to respective intermediate portions of the first and second side beams 140C, 140D of the seat frame 140. Alternatively, the first and second support struts 144A, 144B could be pivotally connected to spaced-apart portions of the front beam 140A of the seat frame.

The first and second side portions 134A, 134B of the upper frame section 106 are shown as identical to or mirror images of each other. As such, only the first side portion 134A will be described in detail herein. The first side portion 134A includes a lower, L-shaped section 150 and an upper, J-shaped section 152. The lower L-shaped section 150 is oriented with the free end of a first leg 150A thereof generally perpendicular to and attached to the first side beam 140C of the seat frame proximate the second end thereof. The upper J-shaped section 152 is oriented with the free end of a first leg 152A thereof generally perpendicular to and attached to the first side beam 140A of the seat frame proximate the first end thereof. The lower L-shaped section 150 is further oriented with the free end of a second leg 150B thereof generally parallel to and spaced from the first side beam 140C of the seat frame, and generally perpendicular and attached to the first leg 152A of the upper J-shaped section 152A intermediate the free end and a second end thereof. The upper J-shaped section 152 is further oriented with the free end of a third leg 152C thereof generally perpendicular to and attached to the second leg 150B of the lower L-shaped section 150 intermediate the free end and a second end thereof. The upper J-shaped section 152 also includes a second leg 152B extending between second ends of the first leg 152A and the third leg 152C thereof. The first side portion 134A may include one or more brackets or tabs 154 attached to and extending from the lower L-shaped section 150 and/or the upper J-shaped section 152 thereof. The bracket(s) or tab(s) 154 may be used to attach upholstery or other structure to the first side portion 134A.

Figure 3:
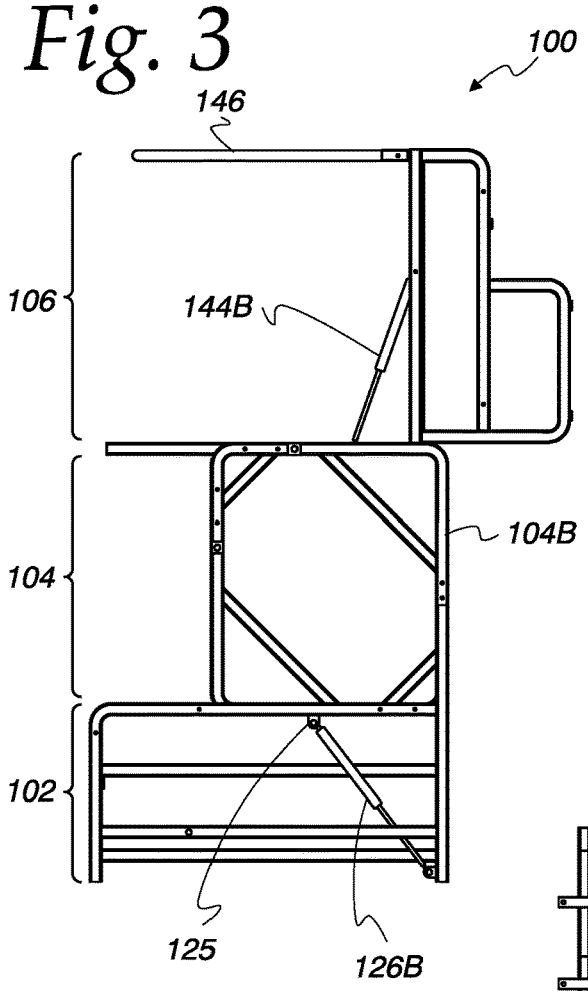
FIG. 3 is an end elevation view of the framework of the illustrative collapsible enclosure of FIG. 1, with the frame work in a fully deployed position.

As best shown in FIGS. 1, 3, and 4, the collapsible enclosure 100 can be placed in a first (or deployed) configuration wherein the collapsible enclosure can be used as a privacy enclosure. In the first configuration, the middle frame section 104 is in its first configuration wherein each of the first and second side portions 104A, 104B is in its square configuration. Also, the tilting portion 130 of the upper frame section 106 is pivoted to its second position. The first and second support struts 144A, 144B may assist in transitioning the seating portion 130 between its first and second positions and support it in its second position. The curtain rod 146 is in its second or extended position. In this configuration, a curtain (not shown) can be attached to the curtain rod 146 to form three sides of a four-sided enclosure. The fourth side is implemented by the lower frame section 102, the middle frame section 104, and the upper frame section 106 and upholstery (not shown) disposed thereon.

FIG. 2 shows the collapsible enclosure 100 in the deployed configuration generally, but with the curtain rod 146 folded against the seat bottom 132 in preparation for conversion to a seating unit.

As best shown in FIGS. 5-8, the collapsible enclosure 100 can be configured in a second (or collapsed) configuration in which the collapsible enclosure can be used as a chair or another form of seating unit. The seat web 142 can be covered with a cushion (not shown) or otherwise cushioned and/or upholstered. Also, the horizontal beams of the upper and or lower frame sections 106, 102 could be fitted with armrests (not shown) or otherwise cushioned and/or upholstered. At least the exposed portions of the frame could be cushioned and/or upholstered or otherwise covered with fabric or another material.

Figure 14:
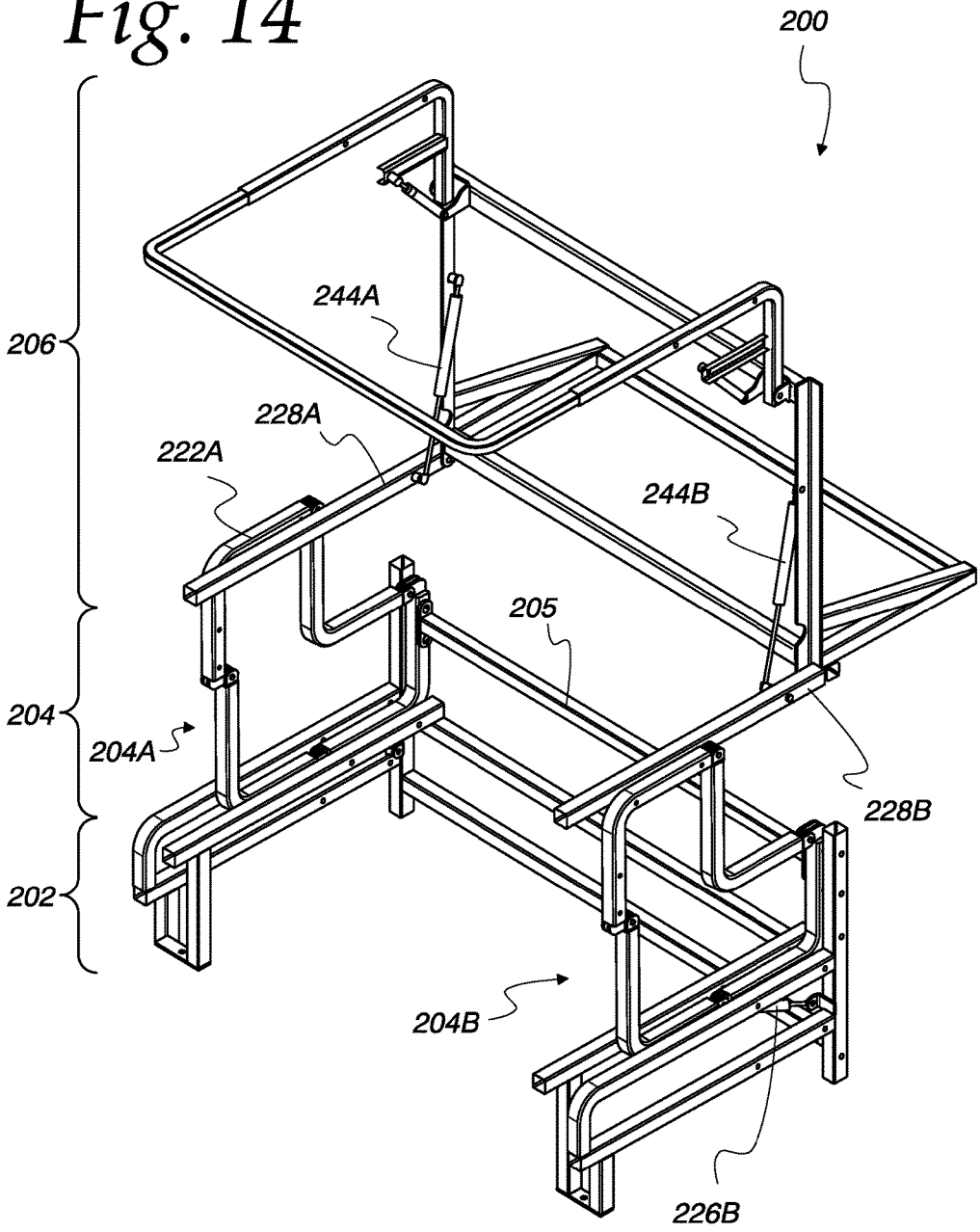
FIG. 14 is a perspective view of a framework of another illustrative collapsible enclosure according to the present disclosure, with the framework in a fully deployed position.

FIGS. 14-20 show another illustrative embodiment of a collapsible enclosure 200 according to the present disclosure. The collapsible enclosure 200 includes a frame that can be transitioned between a first (or deployed or enclosure) configuration, as best shown in FIG. 14, and a second (or collapsed or seating) configuration, as best shown in FIG.

15. The frame is provided in three sections, namely, a lower frame section 202, a middle frame section 204, and an upper frame section 206.

Figure 16:
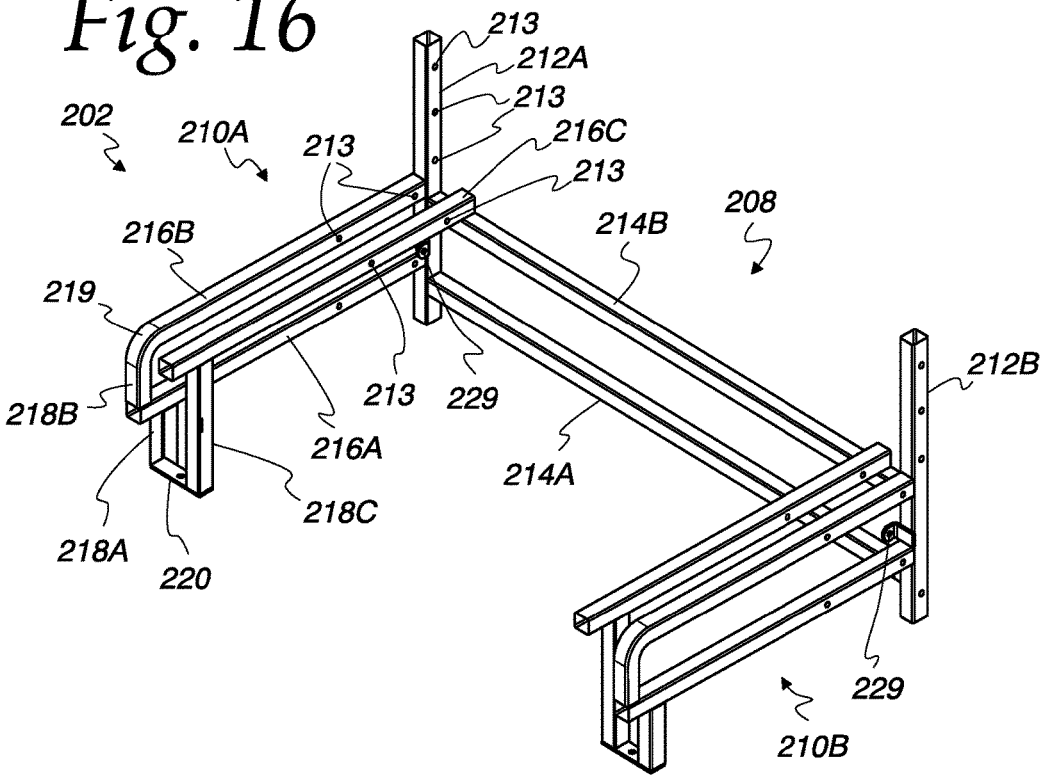
FIG. 16 is a perspective view of a lower frame section of the illustrative collapsible enclosure of FIG. 14.

As best shown in FIG. 16, the lower frame section 202 includes a back portion 208 and first and second side portions 210A, 210B. The back portion 208 is shown as including first and second spaced-apart, parallel vertical posts 212A, 212B and first and second spaced-apart, parallel horizontal beams 214A, 214B, each having a first end attached to the first post 212A and a second end attached to the second post 212B. The first beam 214A is attached to the first and second posts 212A, 212B near respective lower ends thereof, and the second beam 214B is attached to the first and second posts near respective midpoints thereof.

The first and second side portions 210A, 210B are shown as mirror images of each other. As such, only the first side 210A portion will be described herein in detail. The first side portion 210A includes a first vertical post 218A spaced from the first vertical post 212A of the rear portion 208. A first horizontal beam 216A extends from a lower portion of the first vertical post 212A of the back portion 208 beyond the upper end of the first vertical post 218A of the first side portion 210A. The first horizontal beam 216A is connected to the upper end of the first vertical post 218A.

A second vertical post 218B extends upwardly from the end of the first horizontal beam 216A proximate the first vertical post 218A. A second horizontal beam 216B extends from an intermediate portion of the first vertical post 212A of the back portion 208 to the upper end of the second vertical post 218B of the first side portion 210A. The second horizontal beam 216B is connected to the upper end of the second vertical post 218B. As shown, this connection may be made through an intermediate connector 219, as shown. The intermediate connector could be curved, as shown, or have another configuration.

A third horizontal beam 216C of the first side portion 210A extends from the second horizontal beam 214B of the back portion 208 beyond the upper end of a third vertical post 218C of the first side portion 210A. The third horizontal beam 216C is connected to the upper end of the third vertical post 218C. The third horizontal beam 216C and the third vertical post 218C are spaced from and parallel to the first and second horizontal beams 216A, 216B and the first and second vertical posts 218A, 218B. The first vertical post 218A and the third vertical post about the same perpendicular distance from the back portion 208. The first and third horizontal beams 216A, 216C are about the same length. A strap 220, for example, a metal or otherwise generally rigid strap, connects respective lower ends of the first and third vertical posts 218A, 218C.

Each of the first vertical post 212A and the second and third horizontal beams 216B, 216C may define one or more apertures 213 extending therein or there through for receiving fasteners (not shown) that may be used to attach other components thereto, as will be discussed further below.

As best shown in FIG. 14, the middle frame section 204 includes a first side portion 204A and a second side portion 204B. The first side portion 204A is connected to the second side portion 204B by a horizontal connector or beam 205. The first and second side portions 204A, 204B are shown as identical to or mirror images of each other. As such, only the first side portion 204A will be described herein in detail.

Figure 17:
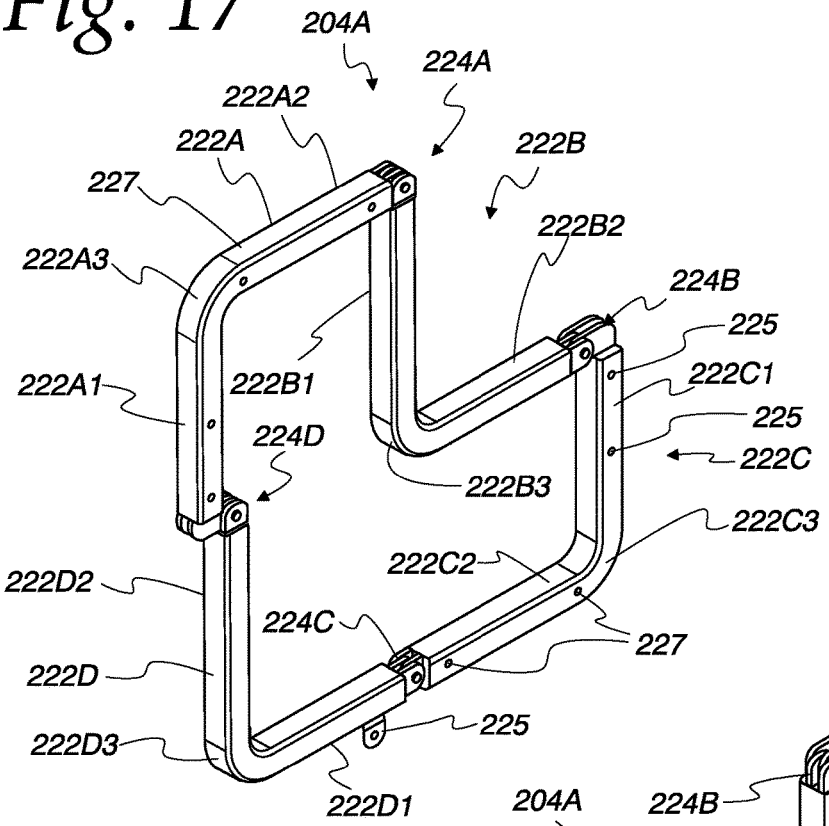
FIG. 17 is a perspective view of a first side portion of a middle frame section of the illustrative collapsible enclosure of FIG. 14 in a fully deployed position.
Figure 18:
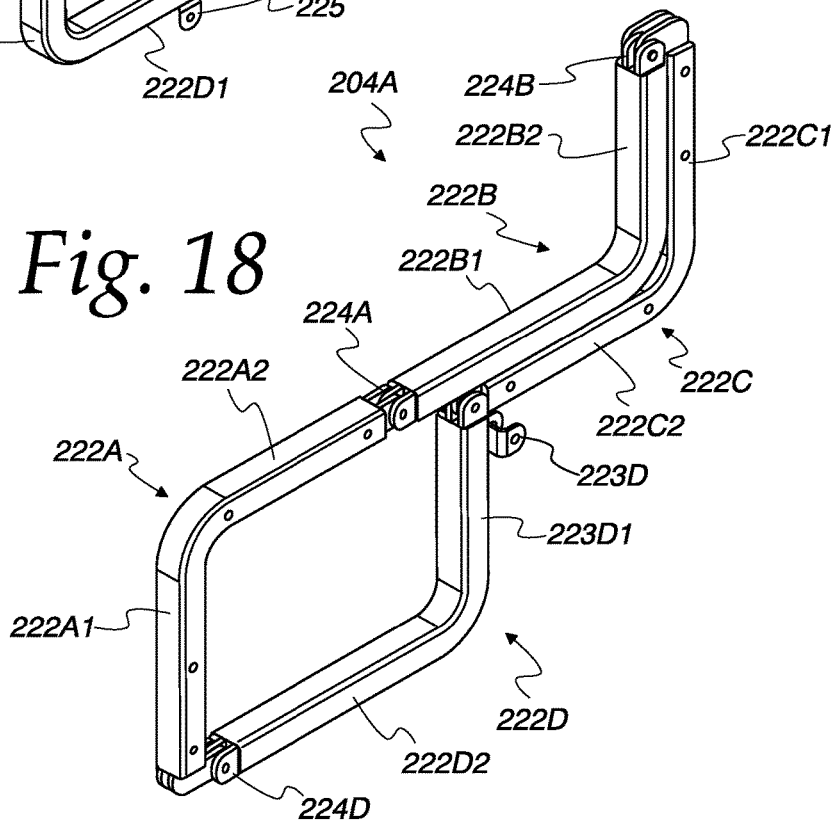
FIG. 18 is a perspective view of the first side portion of the middle frame section of FIG. 17 in a collapsed position.

As best shown in FIGS. 17 and 18, the first side portion 204A includes first, second, third, and fourth L-shaped sections 222A, 222B, 222C, 222D pivotally connected to each other. More specifically, the first side portion 204A includes a first L-shaped section 222A, a second L-shaped section 222B pivotally connected to the first L-shaped section by a first hinge 224A, a third L-shaped section 222C pivotally connected to the second L-shaped section by a second hinge 224B, and a fourth L-shaped section 222D pivotally connected to the third L-shaped section by a third hinge 224C. The fourth L-shaped section 222D also is pivotally connected to the first L-shaped section 222A by a fourth hinge 224D. A U-shaped bracket 223D extends downwardly from the first leg 222D1 of the fourth L-shaped section 222D.

Each of the L-shaped sections 222A, 222B, 222C, 222D is defined by a first leg and a second leg generally perpendicular to the first leg. The first and second legs of each L-shaped section are identified in the drawings with (and may be referred to herein using) the suffixes "1" and "2", respectively. The second leg 222A2 of the first L-shaped section 222A and the first and second legs 222C1, 222C2 of the third L-shaped section 222C may define apertures therein or extending there through for receiving fasteners (not shown) that may be used to attach the first and third L-shaped sections to other components, as will be discussed further below. Also, the first and second legs of each of the L-shaped sections 222A, 222B, 222C, 222D cooperate to define a corresponding corner 222A3, 222B3, 222C3, 222D3.

The first hinge 224A is generally collinear with the second leg 222A2 of the first L-shaped section 222A and the first leg 222B 1 of the second L-shaped section 222B. Similarly, the third hinge 224C is generally collinear with the second leg 222C2 of the third L-shaped section 222C and the first leg 222D1 of the fourth L-shaped section 222D. The second hinge 224B is generally collinear with the second leg 222B2 of the second L-shaped section 222B but laterally offset from the first leg 222C 1 of the third L-shaped section 222C, extending from the first leg 222C1 of the third L-shaped section in the same direction that the second leg 222C2 of the third L-shaped section extends from the second leg of the third L-shaped section. Similarly, the fourth hinge 224D is generally collinear with the second leg 222D2 of the fourth L-shaped section 222D but laterally offset from the first leg 222A1 of the first L-shaped section 222A, extending from the first leg 222A1 of the first L-shaped section in the same direction that the second leg 222A2 of the first L-shaped section extends from the second leg of the first L-shaped section.

FIG. 17 shows the first side portion 204 of the middle frame section 204 in a first (or deployed) configuration. In the deployed configuration, the first through fourth L-shaped sections 222A-222D cooperate to define a six-sided polygon wherein the corners 222A3, 222C3, 222D3 defined by the first, third, and fourth L-shaped sections 222A, 222C, 222D face outwardly from the polygon, and the corner defined by the second L-shaped section 222B faces inwardly into the polygon.

With reference to FIG. 18, which shows the first side portion 204A in a second (or collapsed) configuration, the foregoing offset of the second hinge 224B allows the second L-shaped section 222B to rotate with respect to, and nest generally within, the third L-shaped section 224C. More specifically, the offset allows the second L-shaped section 222B to rotate with respect to the third L-shaped section 224C so that that the second leg 222B2 of the second L-shaped section 222B is generally parallel to the first leg 222C 1 of the third L-shaped section and the first leg 222B 1 of the second L-shaped section is generally parallel to the second leg 222C2 of the third L-shaped section. Also with reference to FIG. 18, the foregoing offset of the fourth hinge 224D allows the fourth L-shaped section to rotate with respect to the third L-shaped section 222C such that the first leg 222D1 of the fourth L-shaped section 222D is generally perpendicular to the second leg 222C2 of the third L-shaped section and the second leg 222D2 of the fourth L-shaped section is generally perpendicular to the first leg 222A1 of the first L-shaped section. In the collapsed configuration, the first leg 222B 1 of the second L-shaped section 222B may rest upon the second leg 222C2 of the third L-shaped section 22C2.

The first through fourth L-shaped sections 222A-222D and the first though fourth hinges 224A-224D are configured so that, as the first side portion 204A is transitioned between the first and second configurations, the first leg 222A1 of the first L-shaped section remains parallel to the first leg 222C1 of the third L-shaped section, and the second leg 222A2 of the first L-shaped section remains parallel to the second leg 222C2 of the third L-shaped section.

The L-shaped sections 222A, 222B, 222C, 222D are shown as having rectangular cross-sections. In other embodiments, the L-shaped sections 222A, 222B, 222C, 222D could have other cross-sections. They could be solid or tubular. The first and second legs thereof could be formed monolithically by bending a piece of stock to the desired form, by joining individual pieces of stock by welding, bonding, or using mechanical fasteners, or any combination thereof.

The third L-shaped section 222C of the first side portion 204A of the middle frame section 204 may be fixed to the lower frame section 202 using fasteners (not shown) or otherwise. For example, the third L-shaped section 222C may be fixed to the first vertical post 212A and/or the second horizontal beam 216B and/or the third horizontal beam 216C of the first side portion 104A. For example, the second leg 222C2 of the third L-shaped section 222C could be sandwiched between the second and third horizontal beams 216B, 216C and secured thereto using fasteners (not shown) extending into and/or through any one or more of the third L-shaped section and the second and third horizontal beams. Additionally or alternatively, the first leg 222C1 of the third L-shaped section 222C could be attached to an inner side of the first vertical post 212A (the side facing the second vertical post 212B) of the back portion 208 using fasteners (not shown) extending into and/or through the third L-shaped section and the first vertical post. So attached, the first and fourth L-shaped sections 222A, 222D may nest between the second and third horizontal beams 216B, 216C when the first side portion 204A is in the collapsed configuration.

As shown, the first and second horizontal side rails 216A, 216B of the lower frame section 102 cooperate with the third horizontal side rail 116C of the lower frame section 102 to define a space receiving at least a portion of at least some of the first through fourth L-shaped sections 222A-222D of the first side portion 204A, especially when the first side portion is in the collapsed configuration.

Figure 15:
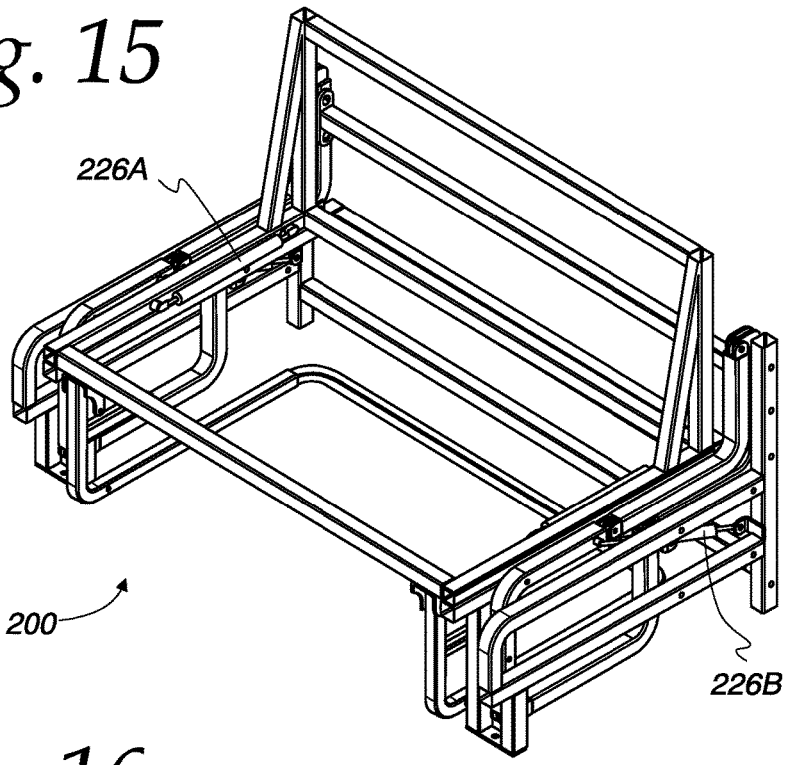
FIG. 15 is a perspective view of the framework of the illustrative collapsible enclosure of FIG. 14, with the frame work in a collapsed position.

As best shown in FIGS. 14 and 15, a first support strut 226A may be pivotally connected between the lower frame section 202 and the fourth L-shaped section 222D of the first side portion 204A of the middle frame section 204 to assist a user in transitioning the middle frame section 104 between the first and second positions. As shown, a first end of the first support strut 226A is pivotally connected to a lower portion of the first vertical post 212A via an intervening bracket 229, and second end of the first support strut 226A is pivotally connected to the fourth L-shaped section 222D via an intervening bracket 225 attached to the first leg 122D1 of the fourth L-shaped section. The first support strut 226A may be a telescopic actuator, for example, a gas strut. A second support strut 226B analogous to the first support strut 226A is shown as pivotally connected between the lower frame section 202 and the second side portion 204B of the middle frame section 204 in an analogous manner.

As set forth above, the second side portion 204B of the middle frame section 204 may be configured in a manner substantially similar to the first side portion 204A of the middle frame section 204. Also, the second side portion 204B may be connected to the lower frame section 202 in a similar manner similar to the first side portion 204A and transition between first and second positions in a manner substantially similar to the first side portion 204A.

Figure 19:
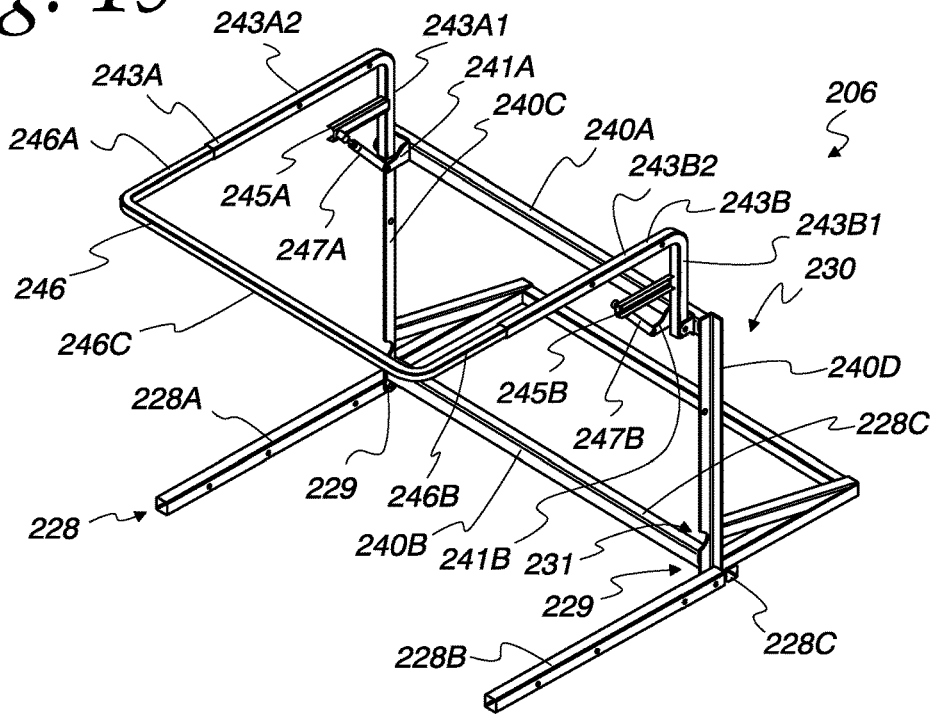
FIG. 19 is perspective view of an upper frame section of the illustrative collapsible enclosure of FIG. 11 in a fully deployed position.
Figure 20:
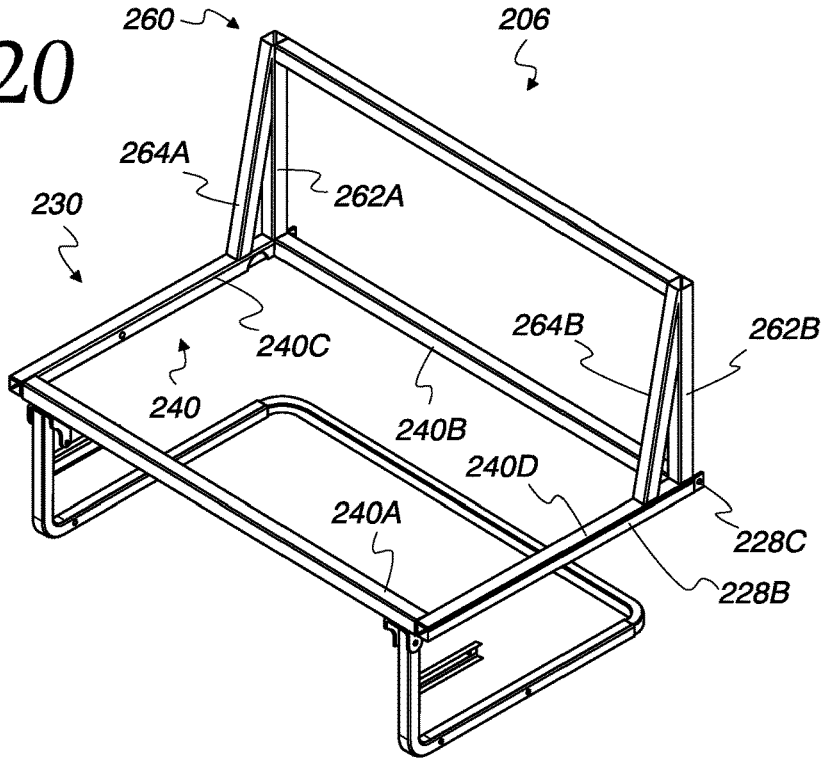
FIG. 20 is a perspective view of an upper frame section of the illustrative collapsible enclosure of FIG. 11 in a collapsed position.

As best shown in FIGS. 19 and 20, the upper frame section 206 includes a base portion 228 and a tilting portion 230 pivotally connected to the base portion. The base portion 228 includes first and second parallel and spaced-apart horizontal side beams 228A, 228B and a horizontal rear beam 228C connected between respective first (or rear) ends of the first and second side beams. As best shown in FIG. 14, the first and second side beams 228A, 228B of the base portion 228 are connected, respectively, to opposing surfaces of the first L-shaped sections 222A of the first and second side portions 204A, 204B of the middle frame section 204.

The tilting portion 230 includes a rectangular seat frame 240 including a front beam 240A, a rear beam 240B, and first and second side beams 240C, 240D connecting respective first and second ends of the front and rear beams. The front and rear beams 240A, 240B are shown as square tubular members, and the first and second side beams 240C, 240D are shown as structural angles. The first and second side beams 240C, 240D of the seat frame are pivotally connected at respective first (or rear) ends thereof to the respective side beams 228A, 228B of the base portion 228 proximate the rear beam 228C thereof by hinges 229. The first and second side beams 240C, 240D of the seat frame may define respective notches or otherwise be configured as might be necessary to permit pivoting thereof with respect to the respective side beams 228A, 228B of the base portion 228.

The tilting portion 230 may include a seat web (not shown) similar to the seat web 142 of the collapsible enclosure 100. The seat web may be attached to the seat frame 240 in a manner similar to that in which the seat web 142 is attached to the seat frame of the collapsible enclosure 100.

A back frame 260 may be attached to the seat frame 240. As shown, the back frame 260 includes a first generally upright post 262A extending upwardly from a first end of the rear horizontal beam 240B or an adjacent end of the first horizontal side beam 240C, and a second generally upright post 262B extending upwardly from a second end of the rear horizontal beam 240B or an adjacent end of the second horizontal side beam 240D. The back frame 260 may further include a first brace 264A extending from the first post 262A to the first side beam 240C, and a second brace 264B extending from the second post 262B to the second side beam 240D. The first and second posts 262A, 262B are shown as generally perpendicular to the seat frame 240, but could be set at other angles thereto. Similarly, the first and second braces 264A, 264B are shown at a particular angle with respect to the first and second posts 262A, 262B and attached thereto at respective upper ends thereof, but the first and second braces could be at other angles with respect to the first and second posts and could be attached thereto at other locations.

The upper frame section 206 also includes first and second support struts 244A, 244B pivotally connected between the base portion 228 and the seat portion 230. As shown, the first and second support struts 244A, 244B are telescopic actuators, for example, gas struts, pivotally at respective first ends thereof to respective intermediate portions of the first and second side beams 228A, 228B of the base portion 228, and pivotally connected at respective second ends thereof to respective intermediate portions of the first and second side beams 240C, 240D of the seat frame 240. Alternatively, the first and second support struts 244A, 244B could be pivotally connected to spaced-apart portions of the front beam 240A of the seat frame 240.

First and second hinge brackets 241A, 241B are attached to an underside of the front beam 240A. Each hinge bracket 241A, 241B is configured to pivotally engage a corresponding first and second pivot arm 243A, 243B. Each of the first and second pivot arms 243A, 243B is configured as an L-shaped member having a first leg (designated by the suffix "1") pivotally attached to the corresponding hinge bracket 241A, 241B and a second leg (designated by the suffix "2") extending from an end of the first leg opposite the attachment of the first leg to the bracket. Each of the first and second pivot arms 243A, 243B may further include a corresponding strut support member 245A, 245B extending from the first leg in the same direction as the second leg and parallel to the second leg. A corresponding support strut 247A, 247B may be pivotally connected between each hinge bracket 243A, 243B and the corresponding pivot arm 245A, 245B.

A U-shaped curtain rod 246 having first and second legs 246A, 246B and a cross bar 246C joining ends of the first and second legs extends from the first and second pivot arms 243A, 243B. More specifically, the first and second legs 246A, 246B extend, respectively, from the first and second pivot arms 243A, 243B. The first and second legs 246A, 246B may extend telescopically from the pivot arms 243A, 243B so the distance between the cross bar 246C and the first legs 243A1, 243B1 of the first and second pivot arms 243A, 243B can be varied.

As best shown in FIG. 14, the collapsible enclosure 200 can be placed in a first (or deployed) configuration wherein the collapsible enclosure can be used as a privacy enclosure. In the first configuration, the middle frame section 204 is in its first configuration wherein each of the first and second side portions 204A, 204B is in its polygonal configuration. Also, the tilting portion 230 of the upper frame section 206 is pivoted to its second position. The first and second support struts 244A, 244B may assist in transitioning the tilting portion 230 between its first and second positions and support it in its second position. The curtain rod 246 is in its second or deployed position. In this configuration, a curtain (not shown) can be attached to the curtain rod 246 to form three sides of a four-sided enclosure. The fourth side is implemented by the lower frame section 202, the middle frame section 204, and the upper frame section 206 and upholstery or another covering (not shown) disposed thereon.

As best shown in FIG. 15, the collapsible enclosure 200 can be configured in a second (or collapsed) configuration in which the collapsible enclosure can be used as a chair or another form of seating unit. The seat frame could be provided with a web (not shown) covered with a cushion (not shown) or otherwise cushioned and/or upholstered. Also, the horizontal beams of the upper and/or lower frame sections 206, 202 could be fitted with armrests (not shown) or otherwise cushioned and/or upholstered. At least the exposed portions of the frame could be cushioned and/or upholstered or otherwise covered with fabric or another material.

Figure 21:
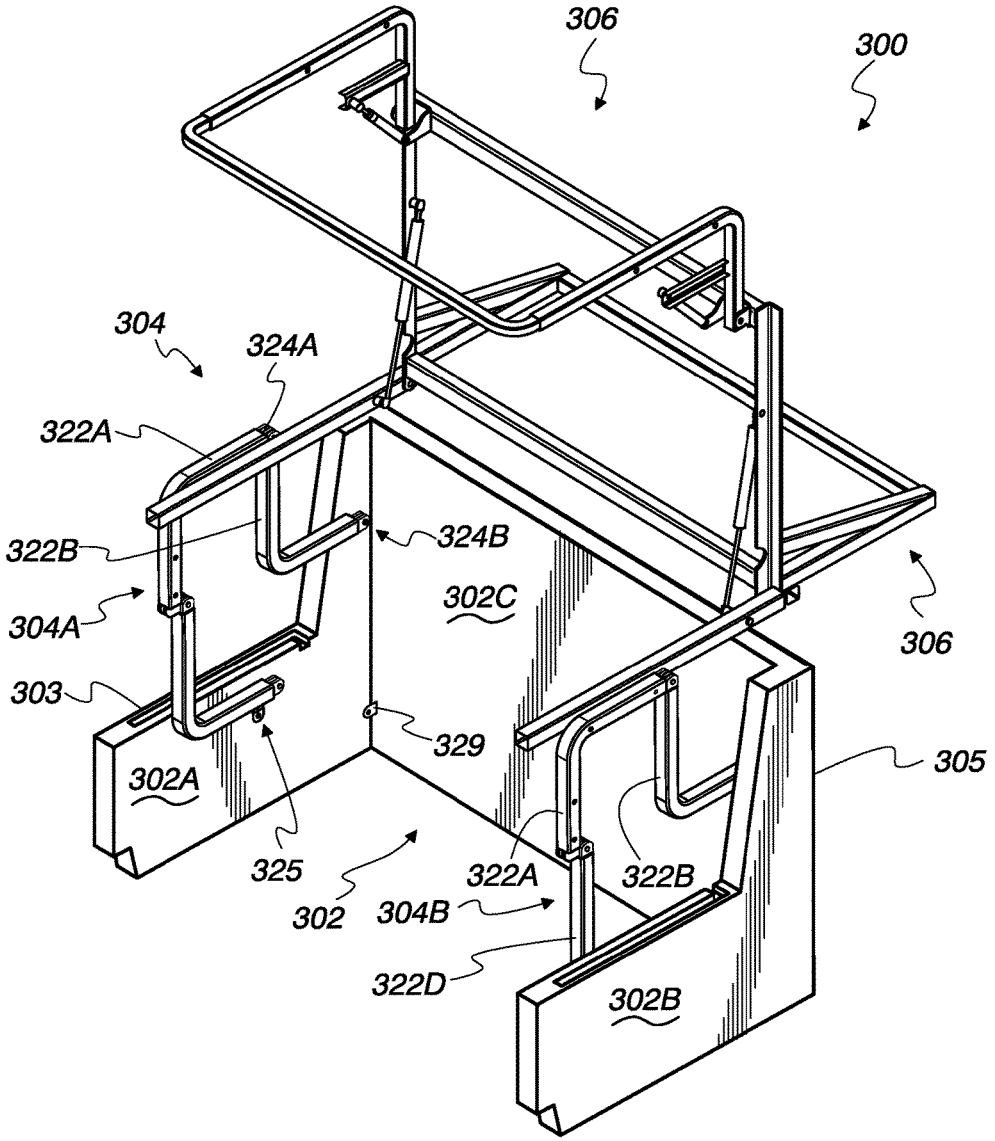
FIG. 21 is a perspective view of a further embodiment of a lower frame section of a collapsible enclosure according to the present disclosure.

FIG. 21 illustrates another embodiment of a collapsible enclosure 300 similar to the collapsible enclosure 200, but including a different form of lower frame section 302 and a modified middle frame section 304. The lower frame section 302 includes first, second and rear walls 302A, 302B, 302C, rather than the tubular structure of the lower frame section 202. The back wall 302C is shown as generally rectangular. Each of the first and second side walls 302A, 302B has a generally rectangular forward portion and a buttress 305 extending from the forward portion to the rear wall 302C. The walls 302A, 302B, 304C may be opaque, translucent, or otherwise view blocking. They may be, but need not be, solid or imperforate.

As shown, the middle section 304 includes first and second side portions 304A, 304B similar to the first and second side portions 204A, 204B of the collapsible enclosure 200, but the side portions 304A, 304B omit an L-shaped section analogous to the third L-shaped section 222C of the side portions 204A, 204B. As such, a second L-shaped section 322B of each side portion 304A, 304B is pivotally connected via a second hinge 324B to the rear wall 302C or to a rear portion of the respective side wall 320A, 302B of the lower frame section 302, and a third L-shaped section 322D analogous to the fourth L-shaped section 222D of the enclosure 200 is pivotally attached via a fourth hinge 324D to the respective side wall 302A, 302B. First and second struts (not shown, analogous to struts 226A, 226B) could be connected between the lower frame section 302 and the respective side portions 304A, 304B. For example, a first end of such a support strut could be pivotally attached to a bracket 329 located analogously to the bracket 229, and a second end of such a support strut could be pivotally attached to a bracket 325 located analogously to the bracket 225.

The collapsible enclosure 100 could be modified in a similar manner to include a lower frame section analogous to the lower frame section 302.

Various embodiments of a collapsible enclosure are described herein. Features described in connection with any of the embodiments may be incorporated into any other embodiment to the extent possible.

The invention claimed is:

1. A collapsible enclosure comprising:

a lower frame;

a middle frame comprising:

a first L-shaped portion;

a second L-shaped portion pivotally connected to the first L-shaped portion and fixedly connected to the lower frame;

a third L-shaped portion pivotally connected to the second L-shaped portion; and a fourth L-shaped portion pivotally connected to the third L-shaped portion and pivotally connected to the first L-shaped portion;

wherein the middle frame is reconfigurable between a first position in which the first, second, third and fourth L-shaped portions of the middle frame cooperate to define a four-sided structure and a second position in which the first, second, third and fourth L-shaped portions of the middle frame cooperate to define an eight-sided structure; and wherein the first and third L-shaped portions of the middle frame rotate with respect to the second and fourth L-shaped portions of the middle frame when the middle frame is reconfigured between the first and second positions and the second and fourth L-shaped portions of the middle frame translate with respect to the first and third L-shaped portions of the middle frame when the middle frame is reconfigured between the first and second positions; and an upper frame comprising:

a base portion fixedly connected to the fourth portion of the middle frame; and a pivoting portion pivotally connected to the base portion, wherein the fourth L-shaped portion is disposed outside the lower frame when the middle frame is in the first position, and wherein the fourth L-shaped portion is at least partially disposed within the lower frame when the middle frame is in the second position.

2. The collapsible enclosure of claim 1 further comprising a first extendable and retractable strut connected to the lower frame and the middle frame or to the middle frame and the upper frame.

3. The collapsible enclosure of claim 2 further comprising a second extendable and retractable strut connected to the lower frame and the middle frame or to the middle frame and the upper frame.

4. The collapsible enclosure of claim 3 where the first extendable and retractable strut is connected to the lower frame and the middle frame and the second extendable and retractable strut is connected to the middle frame and the upper frame.

5. The collapsible enclosure of claim 4, the upper frame further comprising a curtain support pivotally attached to the body pivoting portion.

6. A collapsible enclosure comprising:

a lower frame;

a middle frame comprising:

a first L-shaped portion;

a second L-shaped portion pivotally connected to the first L-shaped portion and fixedly connected to the lower frame;

a third L-shaped portion pivotally connected to the second L-shaped portion; and a fourth L-shaped portion pivotally connected to the third L-shaped portion and pivotally connected to the first L-shaped portion;

wherein the middle frame is reconfigurable between a first position in which the first, second, third and fourth L-shaped portions of the middle frame cooperate to define a four-sided structure and a second position in which the first, second, third and fourth L-shaped portions of the middle frame cooperate to define an eight-sided structure; and wherein the first and third L-shaped portions of the middle frame rotate with respect to the second and fourth L-shaped portions of the middle frame when the middle frame is reconfigured between the first and second positions and the second and fourth L-shaped portions of the middle frame translate with respect to the first and third L-shaped portions of the middle frame when the middle frame is reconfigured between the first and second positions; and an upper frame comprising:

a base portion fixedly connected to the fourth portion of the middle frame; and a pivoting portion pivotally connected to the base portion, wherein the lower frame and the middle frame define a space for changing clothes when the middle frame is in the first position, wherein the pivoting portion is configured to pivot in a first direction substantially outside the space, and wherein the pivoting portion is configured to pivot in a second direction substantially toward the space.

7. The collapsible enclosure of claim 6 further comprising a first extendable and retractable strut connected to the lower frame and the middle frame or to the middle frame and the upper frame.

8. The collapsible enclosure of claim 7 further comprising a second extendable and retractable strut connected to the lower frame and the middle frame or to the middle frame and the upper frame.

9. The collapsible enclosure of claim 8 where the first extendable and retractable strut is connected to the lower frame and the middle frame and the second extendable and retractable strut is connected to the middle frame and the upper frame.

10. The collapsible enclosure of claim 9, the upper frame further comprising a curtain support pivotally attached to the pivoting portion.

11. The collapsible enclosure of claim 10 wherein a portion of the middle frame nests within a portion of the lower frame when the middle frame is in the second position.

12. A collapsible enclosure comprising:

a lower frame;

a middle frame comprising:

a first L-shaped portion;

a second L-shaped portion pivotally connected to the first L-shaped portion and fixedly connected to the lower frame;

a third L-shaped portion pivotally connected to the second L-shaped portion; and a fourth L-shaped portion pivotally connected to the third L-shaped portion and pivotally connected to the first L-shaped portion;

wherein the middle frame is reconfigurable between a first position in which the first, second, third and fourth L-shaped portions of the middle frame cooperate to define a four-sided structure and a second position in which the first, second, third and fourth L-shaped portions of the middle frame cooperate to define an eight-sided structure; and wherein the first and third L-shaped portions of the middle frame rotate with respect to the second and fourth L-shaped portions of the middle frame when the middle frame is reconfigured between the first and second positions and the second and fourth L-shaped portions of the middle frame translate with respect to the first and third L-shaped portions of the middle frame when the middle frame is reconfigured between the first and second positions; and an upper frame comprising:

a base portion fixedly connected to the fourth portion of the middle frame; and a pivoting portion pivotally connected to the base portion, wherein the pivoting portion is configured to pivot about ninety degrees with respect to the base portion.

13. The collapsible enclosure of claim 12 further comprising a first extendable and retractable strut connected to the lower frame and the middle frame or to the middle frame and the upper frame.

14. The collapsible enclosure of claim 13 further comprising a second extendable and retractable strut connected to the lower frame and the middle frame or to the middle frame and the upper frame.

15. The collapsible enclosure of claim 14 where the first extendable and retractable strut is connected to the lower frame and the middle frame and the second extendable and retractable strut is connected to the middle frame and the upper frame.

16. The collapsible enclosure of claim 15, the upper frame further comprising a curtain support pivotally attached to the pivoting portion.

17. The collapsible enclosure of claim 16 wherein a portion of the middle frame nests within a portion of the lower frame when the middle frame is in the second position.

* * * * *